United States Patent [19]

Miyajima et al.

[11] 4,325,645

[45] Apr. 20, 1982

[54] INKED RIBBON CARTRIDGE HAVING A GUIDE PLATE

[75] Inventors: Mikio Miyajima, Nishine; Kohsaki Yanata, Morioka; Fujio Sasaki; Fumihisa Hori, both of Tamajama; Hideki Fujimoto, Tokyo, all of Japan

[73] Assignee: Alps Electric Co., Ltd., Tokyo, Japan

[21] Appl. No.: 114,511

[22] Filed: Jan. 23, 1980

[30] Foreign Application Priority Data

Jan. 24, 1979 [JP] Japan ..... 54/7571

[51] Int. Cl.[3] ..... B41J 33/10

[52] U.S. Cl. ..... 400/196.1; 400/208; 400/248

[58] Field of Search ..... 400/194, 195, 196, 196.1, 400/207, 208, 208.1, 248, 697.1

[56] References Cited

U.S. PATENT DOCUMENTS

| | | | |
|---|---|---|---|
| 2,077,379 | 4/1937 | Dobson | 400/196 X |
| 2,873,015 | 2/1959 | Gray | 400/208.1 |
| 3,017,981 | 1/1962 | Keith | 400/248 |
| 3,904,017 | 9/1975 | Frechette | 400/196.1 |
| 3,904,018 | 9/1975 | Denley | 400/196 |
| 3,905,465 | 9/1975 | Frechette et al. | 400/697.1 X |
| 3,918,569 | 11/1975 | Parker | 400/248 X |
| 3,941,231 | 3/1976 | Matuck et al. | 400/196.1 |
| 4,046,247 | 9/1977 | Laspesa et al. | 400/196 |
| 4,071,132 | 1/1978 | Steinke et al. | 400/196 X |
| 4,074,800 | 2/1978 | Steinke | 400/195 |
| 4,088,218 | 5/1978 | Depew | 400/196.1 X |
| 4,156,572 | 5/1979 | Carena | 400/196 |
| 4,165,188 | 8/1979 | Rempel | 400/248 X |

FOREIGN PATENT DOCUMENTS

| | | | |
|---|---|---|---|
| 2757993 | 6/1979 | Fed. Rep. of Germany | 400/208 |

*Primary Examiner*—Ernest T. Wright, Jr.

*Attorney, Agent, or Firm*—Guy W. Shoup; Gerard F. Dunne

[57] ABSTRACT

In an endless inked ribbon cartridge wherein an inked ribbon received in a chamber is drawn out from the receiving chamber by a guide arm and then fed into the receiving chamber by another guide arm, and the inked ribbon is exposed between the guide arms for printing, a guide plate is disposed which covers the exposed inked ribbon except a part necessary for printing, thereby to prevent the inked ribbon from staining fingers or paper and from severing accidentally.

8 Claims, 8 Drawing Figures

INKED RIBBON CARTRIDGE HAVING A GUIDE PLATE

BACKGROUND OF THE INVENTION

The present invention relates to an inked ribbon cartridge, and more particularly to an endless inked ribbon cartridge for use in printers and typewriters.

The inked ribbon cartridge of this type comprises a chamber for receiving an inked ribbon, a guide arm for drawing out the inked ribbon from the receiving chamber, and a guide arm for feeding the inked ribbon into the receiving chamber, the inked ribbon being exposed between the two guide arms. Such inked ribbon cartridges are disclosed in, for example, U.S. Pat. Nos. 4,071,132 and 4,074,800.

In the devices of these patents, however, the inked ribbon is fully exposed between the guide arms, which has brought about such disadvantages that the inked ribbon may touch the paper to taint it, or stain the fingers of an operator, and that the inked ribbon may easily be severed accidentally.

SUMMARY OF THE INVENTION

It is therefore an object of the present invention to provide an inked ribbon cartridge which comprises a front guide plate for covering an inked ribbon other than its part necessary for printing and can accordingly prevent the stains of fingers and paper due to the inked ribbon, and the accidental severance of the inked ribbon.

Another object of the present invention is to provide an inked ribbon cartridge in which an inked ribbon does not loosen and is smoothly guided.

Still another object of the present invention is to provide an inked ribbon cartridge in which an inked ribbon does not deviate from a predetermined region in case of turning the cartridge at the change-over between red and black.

Yet another object of the present invention is to provide an inked ribbon cartridge which is simple in structure and easy in assemblage and is accordingly low in cost.

Other objects and advantages will become apparent from the following description taken in conjunction with the drawing.

PREFERRED EMBODIMENT OF THE INVENTION

Hereunder, the details of the present invention will be described in connection with an embodiment illustrated in FIGS. 1–8.

Figure 1:
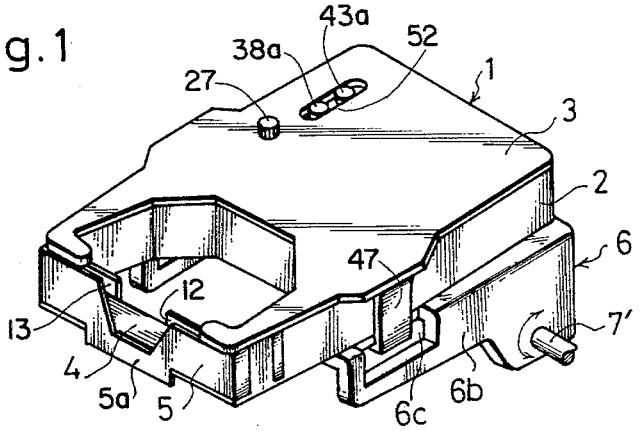
FIG. 1 is a perspective view of an inked ribbon cartridge according to an embodiment of the present invention.

FIG. 1 is a perspective view showing the mounted state of an inked ribbon cartridge (hereinbelow, simply termed "cartridge"). Referring to the figure, the cartridge generally indicated by numeral 1 includes a case 2 which is made of a synthetic resin, a cover 3 which is also made of a synthetic resin and which covers the open surface of the case 2, an endless inked ribbon 4 which is folded and received in a chamber 7 of the case 2, and a front guide plate 5 which is made of a metal sheet and which fully covers the front of the inked ribbon 4 except the part of the inked ribbon 4 exposed for printing in a printing position.

Figure 7:
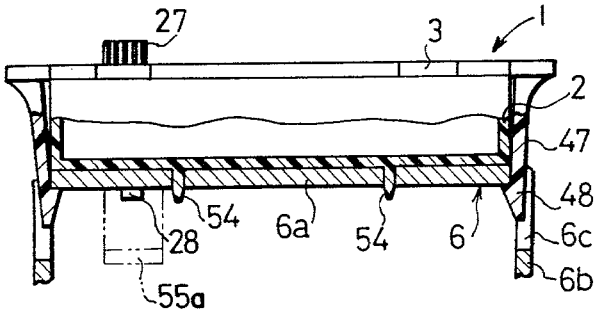
FIG. 7 is a front view, partially in section, showing the state in which the cartridge is mounted on a table.
Figure 8:
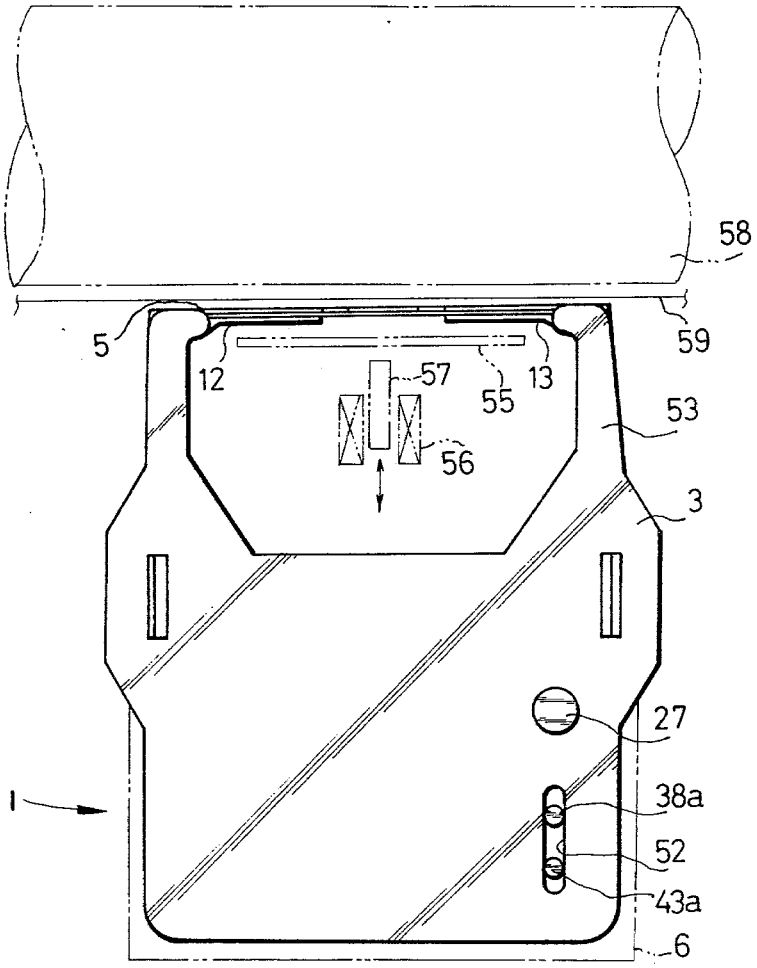
FIG. 8 is a simplified plan view showing the relationship between the cartridge and printing members.

Numeral 6 designates a table on which the cartridge 1 is mounted. The table 6 forms a part of a carriage on which a type wheel 55, a hammer 57 etc. to be described later, and shown in FIG. 8, are mounted. Shown at 7' is a supporting shaft which turnably holds the table 6 and both ends of which are secured to the carriage. The supporting shaft 7' serves as the center of rotation in the case where, in order to change-over the inked ribbon 4 between two regions of red and black into which the inked ribbon is separated in the vertical direction, the table 6 is turned by appropriate drive means such as an electromagnetic plunger. Symbol *6a* indicates a flat portion of the table 6 for placing the cartridge 1 thereon (refer to FIG. 7), symbol *6b* a wing portion bent downwards from the flat portion *6a*, and symbol *6c* a cut-away portion provided in the wing portion *6b*.

Figure 2:
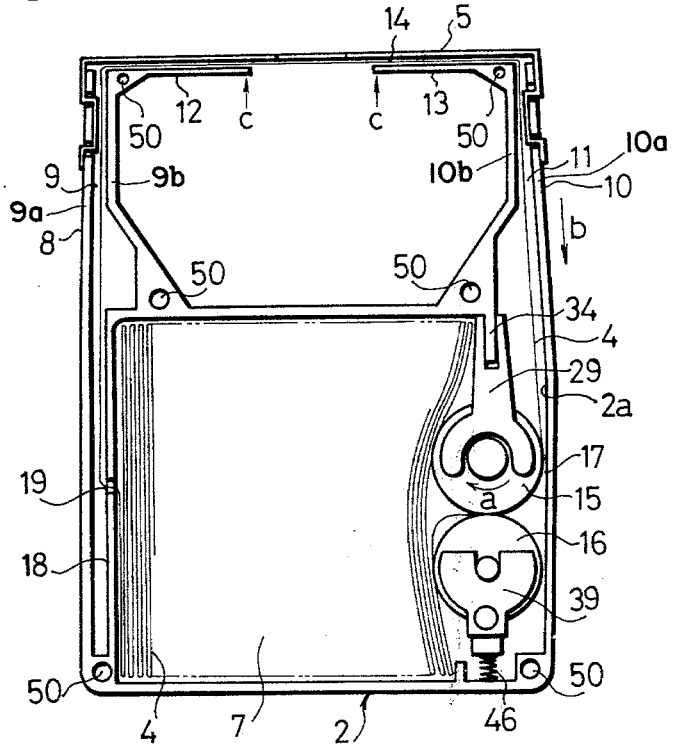
FIG. 2 is a plan view of the cartridge showing the state in which a cover is detached.

FIG. 2 is a plan view of the cartridge 1 showing the state in which the cover 3 is detached. As clearly seen from the figure, the inked ribbon 4 is folded and received in the receiving chamber 7. Numeral 8 indicates a first guide arm which has a guide passageway 9 defined by outer side wall *9a* and inner side wall *9b* for delivering the inked ribbon 4, while numeral 10 indicates a second guide arm which has a guide passageway 11 defined by outer side wall *10a* and inner side wall *10b* for feeding the inked ribbon 4 into the receiving chamber 7. Both the guide arms 8 and 10 extend in an identical direction from the receiving chamber 7, with equal lengths and parallel to each other. First and second rear guide plates 12 and 13 extend inwardly from the outer end portions of the respective inner side walls *9b* and *10b* of the first and second guide arms 8 and 10 so as to come close to each other, respectively. The front guide plate 5 made of the metal sheet referred to above is laid between the guide arms 8 and 10 and along the first and second rear guide plates 12 and 13. The front guide plate 5 and the first and second rear guide plates 12 and 13 are arranged generally in parallel, and the inked ribbon 4 is passed within a narrow passageway 14 which is defined between the front guide plate 5 and the rear guide plates 12 and 13.

A feed roller 15 and a driven roller 16 for driving the inked ribbon 4 function to feed into the receiving chamber 7 the inked ribbon 4 held between both the rollers 15 and 16. The interspace between the feed roller 15 and an inner wall *2a* of the case 2 serves as a narrow guide passageway 17, which prevents the entanglement, loosening etc. of the inked ribbon 4 to be fed in between both the rollers 15 and 16. A slit 19 for delivering the inked ribbon 4 is provided in a partition wall 18 on the delivery side of the receiving chamber 7.

As apparent from the above, the inked ribbon 4 is led from the receiving chamber 7 back into the same by successively passing through the guide passageway 9 of the first guide arm 8, the narrow passageway 14 defined between the front guide plate 5 and the rear guide plates 12 and 13, and the guide passageway 11 of the second guide arm 10. By the rotation of the feed roller 15 in the direction of arrow a in FIG. 2, the inked ribbon 4 is fed in the direction of arrow b in the figure. In this case, the inked ribbon 4 is moved and guided under the state under which its whole area is covered except the portion exposed by an opening 23 of the front guide plate 5 and an opening 22 of the rear guide plates 12 and 13 to be described later, so that paper and the like will not be stained by the ribbon 4. Especially, since the inked ribbon 4 is guided through the narrow passageway 14 between the front guide plate 5 and the rear guide plates 12 and 13, it is not feared that the inked ribbon 4 will loosen or that the inked ribbon 4 will shift vertically. More specifically, the free end parts of the rear guide plates 12 and 13 are held in resilient contact with the front guide plate 5 through the inked ribbon 4 as indicated by the direction of arrows c in FIG. 2, and they hold the inked ribbon 4 with suitable frictional forces so as to prevent the latter from shifting.

Figure 3:
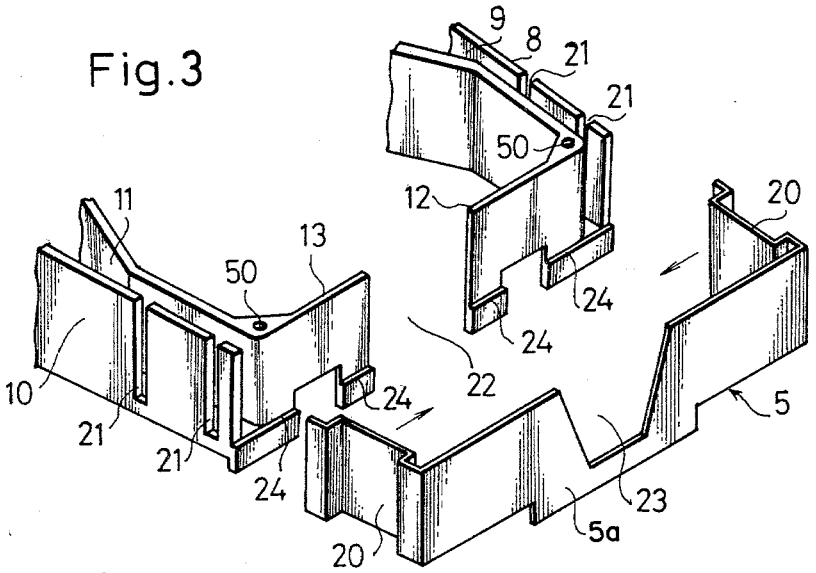
FIG. 3 is an exploded perspective view of essential portions showing the relationship between rear guide plates (a case) and a front guide plate.

As shown in FIG. 3, the front guide plate 5 has its end portions angled toward the chamber 7 and each formed with respective fastening portions 20. The fastening portions 20 are each bent inwardly towards one another in a generally U-shape and are held to the respective guide arms 8 and 10 by being fitted within spaced pairs of slots 21 formed on the respective guide arms 8 and 10. In this case, front guide plate 5 is made of a metal sheet and therefore has a suitable resiliency. In assemblage, both the fastening portions 20 and 20 are held between the thumbs and fingers and flexed inwards (in the directions of arrows in FIG. 3), whereupon the fastening portions 20 and 20 are inserted into the slits 21 of the guide arms 8 and 10. After the insertion and attachment, the front guide plate 5 holds the central concave parts of the fastening portions 20 and 20 in resilient contact with the inner surfaces of the respective guide arms 8 and 10 owing to its resilience and it is securely held and located between both the guide arms 8 and 10.

As apparent from FIG. 3, an opening 22 is formed between the free ends of the first and second rear guide plates 12 and 13, and an opening 23 of the front guide plate 5 is provided in correspondence with the opening 22, so that the inked ribbon 4 is exposed only in the position of the openings 22 and 23, which is the printing position of the ribbon 4. Step portions 24 extend outwardly from the lower parts of each of the rear guide plates 12 and 13, and these step portions 24 abut against the lower end of the inked ribbon 4 so as to prevent the inked ribbon 4 from slipping downwardly. The front guide plate 5 additionally includes a projection 5*a* extending downwardly from the lower portion at a location below the opening 23. Although, in this embodiment, the first and second rear guide plates 12 and 13 are separate elements, they may be made from a unitary element in such a manner that the lower parts of both the rear guide plates 12 and 13 are coupled integrally together.

Figure 4:
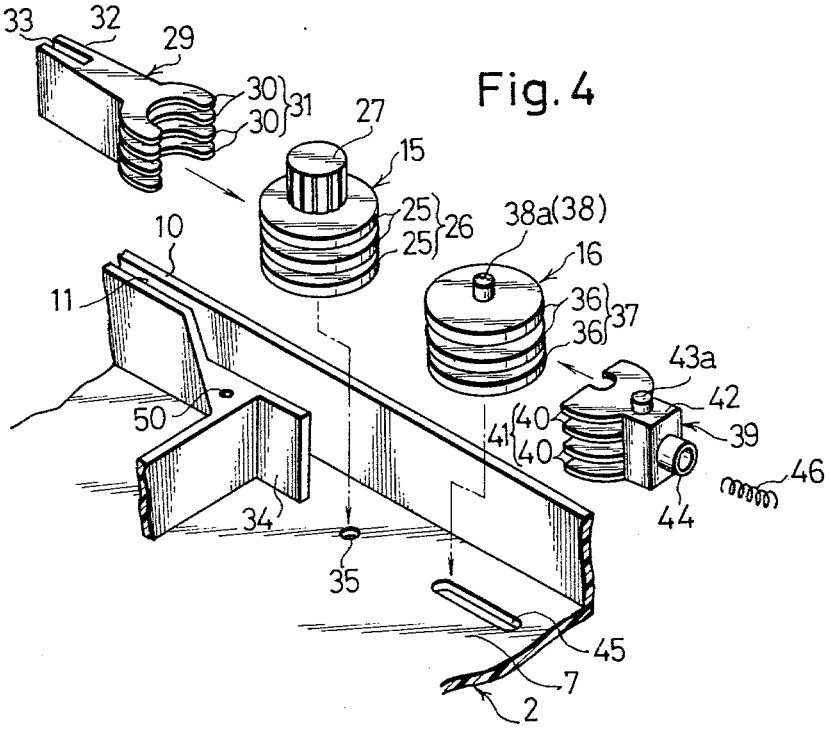
FIG. 4 is an exploded perspective view of essential portions showing a feed roller as well as a driven roller and members associated therewith.
Figure 6:
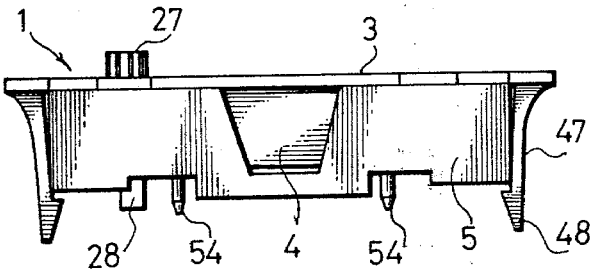
FIG. 6 is a front view of the cartridge showing the state in which the cover and the case are made unitary.

FIG. 4 is an exploded perspective view showing the relationship between the feed roller 15 as well as the driven roller 16 and the case 2. Referring to the figure, the feed roller 15 has a roller portion 26 formed by three discs 25 made of synthetic rubber or the like and stacked one over the other in spaced relation, a shaft portion (not shown) which rotates integrally with the roller portion 26, a knob portion 27 which is disposed at one end of the shaft portion, and a portion 28 disposed at the other end of the shaft portion and adapted to extend through operture 35 to engage drive means as shown in FIGS. 6 and 7. Numeral 29 indicates a first holding member made of a synthetic resin. It has a roller holding portion 31 and a resilient forked portion 32 which is continuous to the roller holding portion 31. The roller holding portion 31 includes a plurality of spaced insert members 30 adapted to receive the discs 25 therebetween. In assemblage, after inserting the roller portion 26 of the feed roller 15 into the roller holding portion 31, the slit 33 of the resilient forked portion 32 is fitted onto a protuberant wall portion 34 of the case 2. Then, the first holding member 29 is securely held on the case 2 by the resilient force of the forked portion 32. In this case, the portion 28 at the lower part of the feed roller 15 penetrates through the aperture 35 provided in the bottom of the case 2 and is led out to the exterior so as to locate the feed roller 15 at a predetermined position.

Similarly to the feed roller 15, the driven roller 16 has a roller portion 37 formed by three spaced discs 36 made of synthetic rubber or the like which are stacked over one another; and a shaft 38 which rotates integrally with the roller portion 37 has its upper and lower parts protruded to form protuberant portions 38*a* (partially omitted from the illustration). A second holding member 39 for holding the driven roller 16 is also made of a synthetic resin. It is unitarily formed with a roller holding portion 41 which is made up of semicircular insert members 40 with their central parts cut out, a base portion 42 which is continuous to the holding portion 41, protuberant portions which are respectively provided at the upper and lower parts of the base portion 42 (only the upper protuberant portion 43*a* being shown in the drawing), and a cylindrical, spring retaining portion 44 which is provided on the rear of the base portion 42. Under the state under which the driven roller 16 is held in the roller holding portion 41 of the second holding member 39, the protuberant portions at the lower parts of the driven roller 16 and the holding member 39 are both inserted into an elongate slot 45 provided in the bottom of the case 2, to locate both the constituents 16 and 39. Further, a compression spring 46 is interposed between the spring retaining portion 44 of the holding member 39 and the inner wall 2*a* of the case 2. Thus, the rollers 15 and 16 are assembled into the state shown in FIG. 2 under which the driven roller 16 is held in resilient contact with the feed roller 15.

Excepting the rollers 15 and 16, the holding members 29 and 39 and the front guide plate 5, all the portions of the case 2 are constructed by a unitary molding. After drawing out a part of the folded inked ribbon 4 and inserting or stretching the drawn-out inked ribbon 4 along the foregoing passageways 9,14 and 11, the front guide plate 5, the rollers 15 and 16 and the holding members 29 and 39 can be mounted on the case 2. Therefore, the job of disposing the inked ribbon 4 into a traveling path through a narrow gap is eliminated. In addition, the constituents which are mounted after the insertion of the inked ribbon 4 can be assembled and held in place merely by press-fitting which does not require any means such as screws. Accordingly, the job efficiency of the assemblage is very good.

Figure 5:
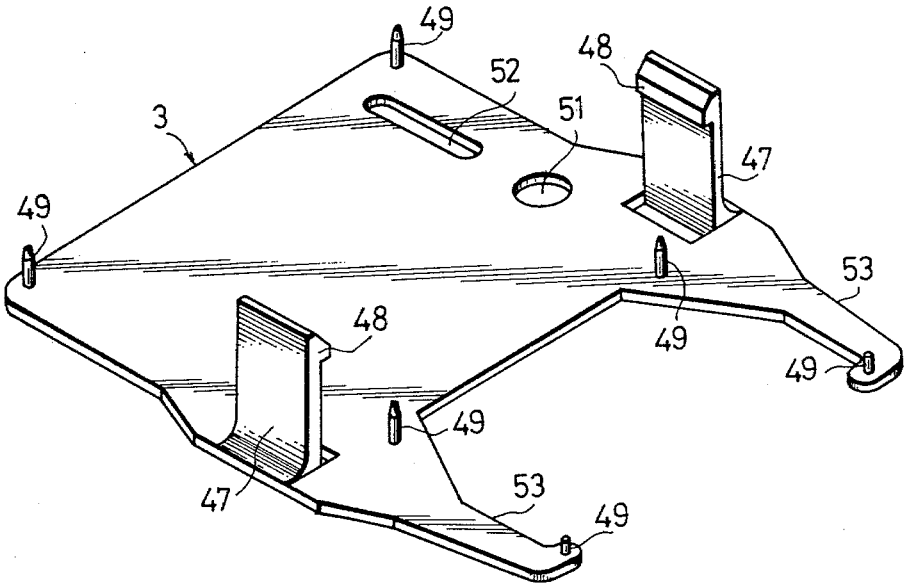
FIG. 5 is a perspective view of the cover.

FIG. 5 is a perspective view of the cover 3 for covering the open surface of the case 2 assembled into the state of FIG. 2 and is shown downside up. The cover 3 made of a synthetic resin is unitarily formed with fastening legs 47 and 47 which are respectively provided with hook-shaped fastening portions 48 and 48 at the fore ends thereof, and projections 49 which are adapted to be inserted in locating apertures 50 (refer to FIG. 2) of the case 2. Numeral 51 designates a circular hole, and numeral 52 a slot.

In attaching the cover 3 to the case 2, the projections 49 of the cover 3 are merely inserted into the corresponding apertures 50 of the case 2, and the fastening legs 47 and 47 disposed at the side parts of the cover 3 hold the outer side surfaces of the case 2 tightly therebetween with resilience forces, whereby the case 2 and the cover 3 are readily made integral (refer to FIG. 6). In this case, since the projections 49 of the cover 3 and the apertures 50 of the case 2 are in engagement with predetermined frictional forces, the cover 3 and the case 2 are securely held together. That is, the cover 3 and the case 2 are endowed with such fitting forces that even when the holding of the case 2 between the aforecited fastening legs 47 and 47 is not made, the cover 3 and the case 2 are not separated by, for example, grasping the cover 3 and lifting the cartridge 1.

Under the state in which the cover 3 is attached to the case 2, the knob portion 27 of the feed roller 15 is fitted through the circular hole 51 of the cover 3, and both the protuberant portions 38*a* and 43*a* of the driven roller 16 and the second holding member 39 are fitted in the slot 52, whereby the location of both the rollers 15 and 16 is made more reliable. Simultaneously, arm portions 53 and 53 of the cover 3 press the fastening portions 20 and 20 of the front guide plate 5, whereby the attachment of the front guide plate 5 is made more reliable. (Refer to FIG. 8.)

Under the state under which the cover 3 and the case 2 are made integral, the fastening portions 48 of the fastening legs 47 of the cover 3 and the bottom side of the case 2 are spaced a distance corresponding to the thickness of the table 6 for mounting the cartridge 1 as illustrated in FIG. 6. The cartridge 1 in the state of FIG. 6 is placed on the flat portion 6*a* of the table 6, and the fastening portions 48 and 48 of the cover 3 are respectively snapped into the cut-away portions 6*c* and 6*c* of the table 6. Thus, the cartridge 1 is brought in one motion into the state shown in FIG. 7 under which it is attached to the table 6 (carriage). That is, also the mounting of the cartridge 1 onto the carriage can be carried out by the one motion operation which does not require screws or the like. In addition, since the fastening legs 47 and 47 of the cover 3 which serve as the mounting pieces onto the case 2 are also used as the mounting members onto the table 6, the structure is simple and the number of components can be reduced. In FIGS. 6 and 7, numerals 54 and 54 indicate projections which are integral with the case 2 and which serve to locate the case 2 to the table 6. Numeral 55*a* indicates the driving gear which is combined with the fit-engagement portion 28 of the feed roller 15 protruding from the bottom of the case 2. By way of example, the control for the printer may interlock the driving gear 55*a* with the operation of the hammer 57 and move the inked ribbon 4 a section corresponding to one digit upon every operation of the hammer 57, as is well known to those skilled in the art.

FIG. 8 is a schematic explanatory view showing one aspect of the relationship between printing members and the cartridge 1 mounted on the table 6 as stated above. Within a space defined by both the guide arms 8 and 10 of the cartridge 1, there are disposed the type wheel 55 which has a large number of type fingers extending radiately and the hammer 57 which is driven by electromagnets 56. A type finger of the type wheel 55 struck with the hammer 57 strikes paper 59 supported on a platen 58, through the inked ribbon 4 exposed to the position of the openings 23 and 22 of the guide plates 5 and 12, 13. Thus, a desired character is printed on the paper 59. In this case, when the table 6 is turned vertically a predetermined amount, either of the regions of the two colors of red and black in the inked ribbon 4 can be selected as described previously.

It is needless to say that the cartridge 1 of the present invention is applicable, not only to the printer illustrated in FIG. 8, but also to a wire dot printer, a type ball printer etc.

What is claimed is:

1. An inked ribbon cartridge comprising:

a chamber containing an inked ribbon therein;

a first guide arm extending outwardly from said chamber and including an inner and outer side wall spaced from one another to define a passageway receiving ribbon leaving said chamber;

a second guide arm extending outwardly from said chamber at a location spaced from said first guide arm and including an inner and outer side wall spaced from one another to define a passageway receiving ribbon returning to said chamber; and means extending between the outer end portions of said first and second guide arms for guiding said ribbon past a printing position while exposing said ribbon at said printing position only, said guiding means including first and second rear guide plates extending towards one another from the end portion of the respective inner side wall of said first and second guide arms and having a space therebetween defining said printing position, a front guide plate lying along said first and second rear guide plates and having an opening at said printing position, said front guide plate being formed of a resilient metallic material and having angled end portions having fastening portions thereon, and engaging means formed on the outer side wall of said first and second guide arms for receiving said fastening portions as said angled end portions are flexed towards one another and holding said angled end portions against their outward resilience whereby said ribbon may be positioned in said printing position and thereafter said front guide plate may be assembled to said first and second guide arms to simplify assembly.

2. An inked ribbon cartridge as in claim 1, said engaging means including slots formed in the outer side walls of said first and second guide arms and open at one end to receive the respective fastening portions, and further including a top cover overlying the open end of said slots and serving to hold said fastening portions therewithin.

3. An inked ribbon cartridge as in claim 1, further including a projection extending downwardly from the lower portion of said front guide plate.

4. An inked ribbon cartridge as in claim 1, the lower portions of said first and second rear guide plates including step portions extending outwardly to prevent the ribbon from slipping downwardly.

5. An inked ribbon cartridge as in claim 1, said front and rear guide plates extending resiliently toward one another to hold said ribbon frictionally therebetween.

6. An inked ribbon cartridge as in claim 1, including a top cover lying over said chamber and including depending arm portions and means formed on the lower ends of said arm portions for holding said cartridge in place in a printer.

7. An inked ribbon cartridge as in claim 6, said top cover being formed of a resilient synthetic resin material and said holding means each including a hook portion for engaging the top of a carriage.

8. An inked ribbon cartridge as in claim 6, said depending arm portions extending inwardly in order to grip the outer surface of said chamber to hold said cover thereto.

* * * * *